US012312829B2

(12) United States Patent
Reid, Jr. et al.

(10) Patent No.: US 12,312,829 B2
(45) **Date of Patent: *May 27, 2025**

(54) SYSTEM AND METHOD FOR PREVENTING ACCESS TO STEPS IN RETRACTED BLEACHERS

(71) Applicant: KOALA WALL, LLC, Lavonia, GA (US)

(72) Inventors: James Reid, Jr., Lavonia, GA (US); Peyton Hart, Royston, GA (US)

(73) Assignee: Koala Wall, LLC, Lavonia, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/232,156

(22) Filed: Aug. 9, 2023

(65) Prior Publication Data

US 2023/0383561 A1 Nov. 30, 2023

Related U.S. Application Data

(63) Continuation of application No. 17/410,319, filed on Aug. 24, 2021, now Pat. No. 11,761,222.

(60) Provisional application No. 63/225,518, filed on Jul. 25, 2021.

(51) Int. Cl.
*E04H 3/12* (2006.01)

(52) U.S. Cl.
CPC ..... *E04H 3/123* (2013.01)

(58) Field of Classification Search
CPC ..... E04H 3/12; E04H 3/123; E04H 3/126; E06B 3/30; E06B 5/025; E06B 9/00; E06B 9/01; E06B 9/02; E06B 2009/002; E06B 2009/005; E06B 2009/007; E06B 2009/015; E04B 2/72; E04B 2/74; E04B 2/7401; E04B 2/7474; E04B 2/82; E04G 21/24; E04G 21/241; E04G 21/243
See application file for complete search history.

(56) References Cited

U.S. PATENT DOCUMENTS 3,446,264 A * 5/1969 Roemer ..... E05F 15/40 160/188
3,667,171 A * 6/1972 McClelland ..... E04H 3/123 52/9
4,571,895 A * 2/1986 Lyman, Jr. ..... E04H 3/123 52/9
4,970,836 A * 11/1990 Brown ..... E04F 19/08 52/507
4,997,165 A * 3/1991 Wiese ..... E04H 3/123 52/9
5,100,108 A * 3/1992 Schultz ..... E04H 3/12 256/73
5,617,674 A * 4/1997 Terrill ..... E06B 9/02 49/55
5,661,928 A * 9/1997 Beu ..... E04H 3/123 160/202

(Continued)

*Primary Examiner* — James M Ference
(74) *Attorney, Agent, or Firm* — Smith Tempel Blaha LLC; Matthew T. Hoots

(57) ABSTRACT

The solution is directed to a bleacher step access prevention system. The system is configured to be locked in place over a stairway of a retracted bleacher system in order to prevent climbing of the stairway when the bleacher system is in a retracted state. Certain embodiments are configured to accommodate handrails of the bleacher system so that handrails do not have to be removed from the stairwell when the bleacher system is in a retracted state.

16 Claims, 13 Drawing Sheets

(56) References Cited

U.S. PATENT DOCUMENTS

| | | | | |
|---|---|---|---|---|
| 5,765,312 | A * | 6/1998 | Szyjkowski | E04F 19/083 49/463 |
| 5,916,091 | A * | 6/1999 | Schultz | E04H 3/123 52/63 |
| 5,921,031 | A * | 7/1999 | Williams | E04H 3/123 52/9 |
| 6,618,996 | B1 * | 9/2003 | Szyjkowski | E05B 65/006 49/465 |
| 8,336,236 | B2 * | 12/2012 | Boltz | G09F 19/22 40/604 |
| 9,650,796 | B2 * | 5/2017 | Klingenberg | E04H 3/123 |
| 10,024,070 | B2 * | 7/2018 | Murphy | E04F 11/1861 |
| 10,053,881 | B2 * | 8/2018 | Briggs | E04H 3/123 |
| 2002/0056239 | A1 * | 5/2002 | Paddock | E04H 3/12 52/9 |
| 2003/0030047 | A1 * | 2/2003 | Ohanesian | E04H 17/1602 256/24 |
| 2011/0163287 | A1 * | 7/2011 | Massameno | E04G 21/24 40/605 |
| 2012/0073169 | A1 * | 3/2012 | Boltz | G09F 19/22 40/606.03 |
| 2012/0073171 | A1 * | 3/2012 | Boltz | G09F 17/00 40/604 |
| 2016/0333580 | A1 * | 11/2016 | Vehniäinen | E04B 2/721 |
| 2017/0051510 | A1 * | 2/2017 | Howell, Jr. | E04F 11/1861 |
| 2023/0021693 | A1 * | 1/2023 | Hart | E04H 3/123 |
| 2023/0383561 | A1 * | 11/2023 | Reid, Jr. | E04H 3/123 |

* cited by examiner

SYSTEM AND METHOD FOR PREVENTING ACCESS TO STEPS IN RETRACTED BLEACHERS

BACKGROUND

The present invention relates to a safety system and method of use thereof and, in particular, to a device configured to prevent access to the step portions of a bleacher system when the bleacher system is in a retracted state.

Indoor gymnasiums, such as basketball gymnasiums, commonly include at least one set of bleachers. Typically, the bleachers are configured to translate between a retracted state and an extended state. When in the extended state, the bleachers provide rows of bench-style seating accessible by stairways, as would be understood by anyone who has ever been a spectator to an event hosted in a gymnasium equipped with bleachers. When in the retracted state, the rows of bench-style seating are unavailable for spectators; however, the stairways provide a tempting and convenient, yet dangerous, way to climb the retracted bleachers. Moreover, because of how the support bracketry is designed for many retractable bleacher systems, climbing the stairways when the bleachers are in a retracted state can compromise the integrity of the support bracketry and, ultimately, cause the bleacher system to fail mechanically.

And so, as any school teacher or coach charged with managing a gymnasium full of kids will attest, keeping kids from climbing the stairway steps when the bleacher system is in a retracted state can be a constant battle. Therefore, there is a need in the art for a system, device and method for physically preventing access to the stairway steps of a bleacher system when in its retracted state.

SUMMARY

Exemplary embodiments of a bleacher step access prevention system are disclosed. Certain embodiments comprise a main panel with a sliding lock mechanism on a front surface and a retracting anchor arm component on the back surface. The retracting anchor arm component is in mechanical communication with the sliding lock mechanism such that actuation of the sliding lock mechanism from an open position to a closed position causes the retracting anchor arm component to transition from a retracted state (i.e., a storage state) to an extended state (i.e., a deployed state). Further, on the back surface of the main panel, one or more anchor arm components may be positioned along an outer edge opposite the edge associated with the aforementioned retracting anchor arm component. With the anchor arm components in a deployed state, and the retracting anchor arm component in a retracted storage state, the system may be rotated into position over a stairway of a retracted bleacher system such that the deployed anchor arm components are received into spaces behind given bleacher benches. Then, the sliding lock mechanism may be transitioned from its open state to its closed state, thereby causing the retracting anchor arm component on the backside of the system to transition to an extended deployed state and be received into a space behind another bleacher bench. Actuation of a lock secures the retracting anchor arm component in the extended deployed position such that the system is secured over the stairway of the retracted bleacher system.

The main panel may also incorporate one or more wheels on the lower end of the panel, along with one or more handles (may be in the form of "cut outs") in the body of the panel. Advantageously, a user may manage the panel by using the handles, tilting the weight of the panel onto the wheels and then pushing or pulling the panel to a desired location (whether to install the panel onto/over a staircase of retracted bleachers or store the panel for future use). Advantageously, the main panel may be curved, undulated, or otherwise contoured to accommodate stair handrails that protrude ahead of a plane defined by the bleacher benches when the bleachers are retracted.

An exemplary embodiment of a bleacher step access prevention system comprises a panel component having a front side and a back side, at least one anchor arm component mounted on the back side of the panel component and in association with a first edge of the panel component, at least one retracting anchor arm component mounted on the back side of the panel component and in association with a second edge of the panel component, and a sliding lock mechanism accessible on the front side of the panel component and operable when actuated to transition between an open state and a closed state. The sliding lock mechanism is configured to transition the at least one retracting anchor arm between a storage state and a deployed state when the sliding lock mechanism is transitioned between said open state and closed state. And, when the panel component is placed in front of a stairway of a retracted bleacher system, the at least one anchor arm component is engaged in a first space behind a first bleacher bench and actuation of the sliding lock mechanism to said closed state causes the at least one retracting anchor arm component to transition to a deployed state and engage in a second space behind a second bleacher bench.

The panel component of the exemplary embodiment may be comprised of a plurality of panels configured to define a cavity for accommodating handrails associated with the stairway of the retracted bleacher system. At least two of the plurality of panels may be connected via hinges in some embodiments. In other embodiments, the plurality of panels that define the panel component may be formed by creasing a single sheet of metal or thermoplastic. In still other embodiments, the plurality of panels that the define the panel component may be welded together.

The panel component of the exemplary embodiment may include one or more handle components accessible from the front side of the panel component. And, the panel component may also comprise at least one caster mounted along a base edge of the panel component. The exemplary embodiment may also include a reinforcement edging component along a base edge of the panel component and/or other edges of the panel component. The panel component may be constructed from a thermoplastic, wood, metal or any other material of construction suitable for the application.

The anchor arm components are configured to transition between a storage state and a deployed state and may include locking pins operable to mechanically hold the anchor arm components in either of the storage state or the deployed state. The retracting anchor arm component may comprise a four bar linkage arrangement. The sliding lock mechanism associated with the retracting anchor arm component may include a lock operable to prevent the sliding lock mechanism from transitioning between open and closed states. The lock may be a keyed lock, but not necessarily.

Advantageously, it is envisioned that embodiments of the solution may have panel components configured to receive and display artwork or advertising.

DETAILED DESCRIPTION

Various embodiments, aspects and features of the present invention encompass a bleacher step access prevention ("BSAP") system. As one of ordinary skill in the art would understand and recognize, when a bleacher system is in its retracted state, the stairways present a dangerous access point at which a person may climb the bleachers. Advantageously, embodiments of the solution may be removably installed over the stairways of a retracted bleacher system such that climbing the retracted bleachers is deterred. That is, installation of a BSAP system according to the solution advantageously blocks access to the stairway of the retracted bleacher set, thereby deterring, if not altogether preventing, climbing the retracted bleacher set at the stairway points. Additionally, it is an advantage of certain embodiments of a BSAP system that the panel component(s) may be configured for mounting or displaying artwork or advertising. In this way, embodiments of the solution may improve the aesthetic of retracted bleacher systems.

Figure 1:
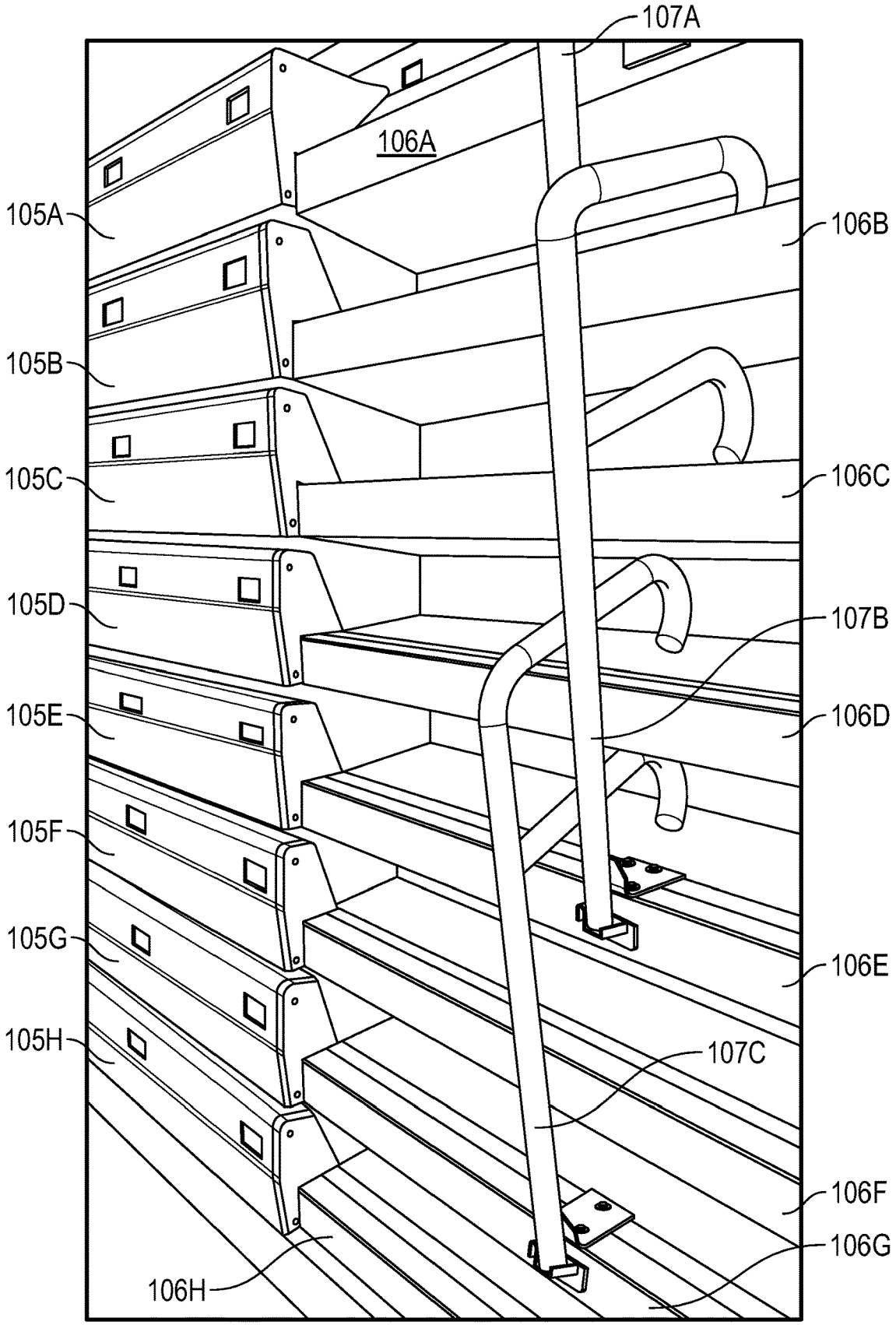
FIG. 1 illustrates an exemplary bleacher system when in its retracted state.

Referring to the FIG. 1 illustration, an exemplary bleacher system is shown in its retracted state. The bleacher system illustrated in FIG. 1 is an example of a typical bleacher system commonly found in school gymnasiums and may vary in size according to the particular gymnasium and application. When the bleacher system is in an extended state (not shown in FIG. 1), the rows of bench-style seats 105 cascade forward such that bench 105H forms a lowest row of seating while bench 105A forms a highest row of seating, as would be understood by one of ordinary skill in the art. Benches 105B, 105C, 105D, 105E, 105F and 105G form rows of seating between those defined by 105A and 105H. Moreover, when in the extended state, the steps 106, each of which is associated with a corresponding bench 105, also cascade forward to form a stairway. That is, step 106A aligns with and corresponds to bench 105A, step 106B aligns with and corresponds to bench 105B, step 106C aligns with and corresponds to bench 105C, step 106D aligns with and corresponds to bench 105D, step 106E aligns with and corresponds to bench 105E, step 106F aligns with and corresponds to bench 105F, step 106G aligns with and corresponds to bench 105G, and step 106H aligns with and corresponds to bench 105H. Notably, and as would be understood by one of ordinary skill in the art of bleacher systems, each of the benches 105 may extend from either and both sides of its associated step 106 (as can also be understood from the illustrations in FIGS. 9 and 11-14). The handrails 107A, 107B and 107C, which are anchored to every other step 106 in the exemplary bleacher system of FIG. 1, provide users with a place to steady themselves as they climb the steps.

When in the retracted state (as demonstrated in FIG. 1), the benches 105 reside in a common vertical plane to essentially form a vertical wall. The steps 106 and handrails 107, however, remain open and present a convenient point for climbing. Commonly, the handrails 107 may be removed when the bleacher system is in a retracted state, but the open nature of the stairway remains a convenient, albeit dangerous, point for climbing. Moreover, climbing the stairway when the bleacher system is in a retracted state can cause damage to the bleacher system.

As will be better understood from the illustrations and descriptions that follow, embodiments of the solution prevent access to stairway portions of a retracted bleacher system. Certain exemplary embodiments shown and described herein require that the handrails 107 be removed prior to installation of the BSAP system while other embodiments of the solution may be configured to accommodate handrails 107 that are not removed when the bleacher system is in a retracted state.

Figure 2:
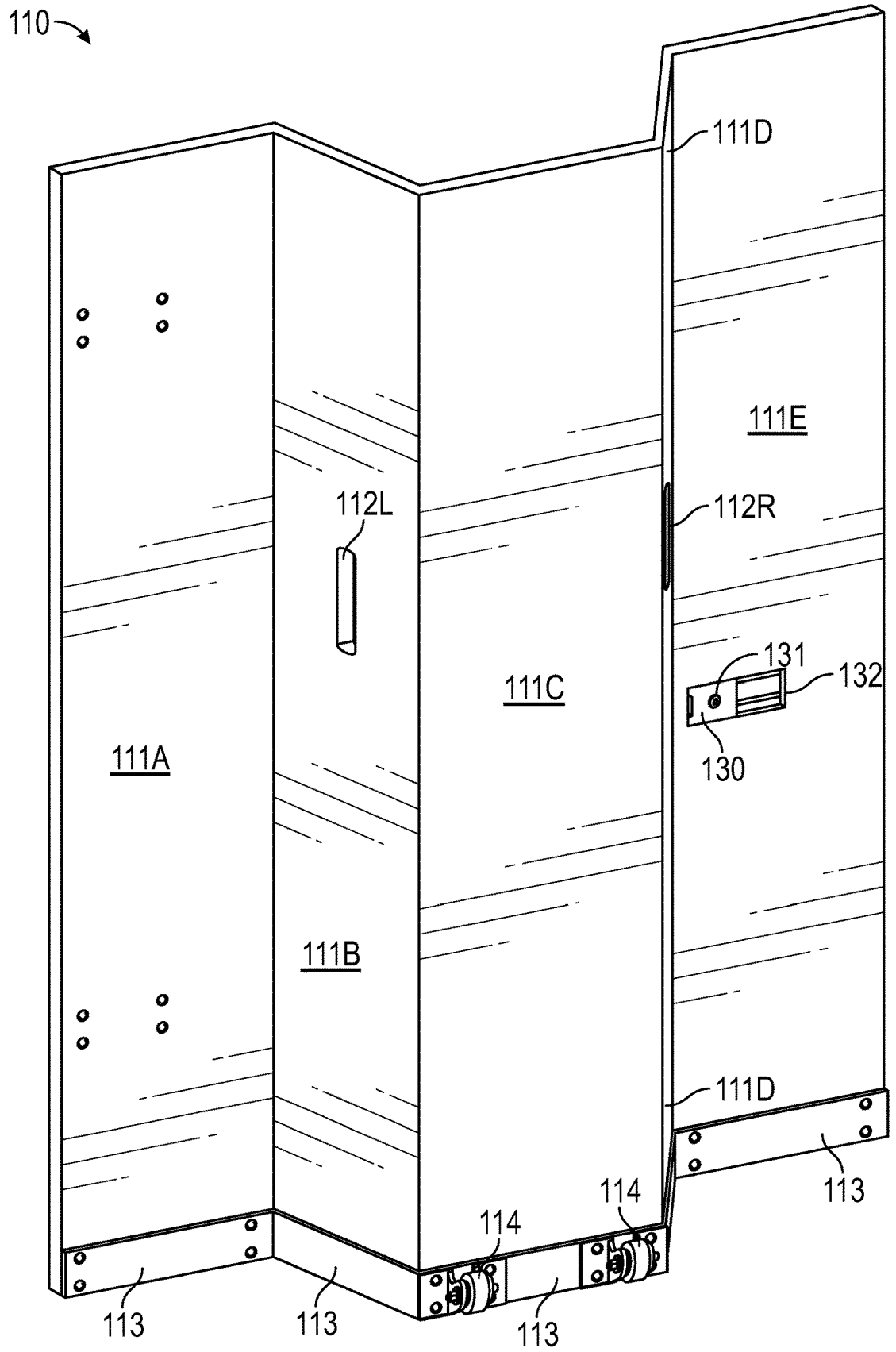
FIG. 2 illustrates the front of an exemplary embodiment of the solution for a bleacher step access prevention system ("BSAP" system)

Turning now to FIG. 2, illustrated is the front of an exemplary embodiment 110 of the solution for a bleacher step access prevention system ("BSAP" system). The embodiment 110 is advantageously configured to prevent access to stairway portions of a retracted bleacher system without any need for the handrails to be removed, as will become clearer from a review of subsequent figures. The particular dimensions of the BSAP embodiment 110 may vary according to the bleacher system for which it is configured.

The BSAP embodiment 110 is formed by a series of integrally connected panels 111. Depending on the particular method manufacture chosen for the BSAP embodiment 110, the panels 111 may be connected via welds, hinges or other mechanical fastening methods known and understood in the art. Or, it is envisioned that some embodiments like BSAP embodiment 110 may be formed from a single "sheet" of material, whether plastic or metal, and creased or bent to define the various panels 111A, 111B, 111C, 111D, 111E illustrated. Moreover, it is envisioned that some embodiments may be injection molded from a suitable thermoplastic. Other embodiments may be manufactured from a combination of materials and methods of construction.

The BSAP embodiment 110 is essentially defined by five integrally connected panels 111A, 111B, 111C, 111D, 111E. Edge panels 111A and 111E may be positioned on a common plane that, when the embodiment 110 is installed over a retracted bleacher system stairwell, roughly aligns with a plane defined by bleacher benches 105 (this may be more easily understood from a review of the illustrations in FIGS. 11 and 12). Central panel 111C may define a plane that is parallel to the plane defined by edge panels 111A and 111E. In this way, it can be understood that panel 111C is positioned "out in front" of edge panels 111A and 111E. Middle panels 111B and 111D may be positioned at angles relative to edge panels 111A, 111E and central panel 111C and, in this way, respectively connect edge panels 111A and 111E to central panel 111C. As will become better understood from subsequent figures and their related descriptions, middle panels 111B, 111D in conjunction with central panel 111C work to define a space for receiving and accommodating handrails on a retracted bleacher system.

The middle panels 111B and 111D each include a handle 112L and 112R, respectively. Although the handles 112 are depicted as "cutouts" in the panels 111B and 111D, it is envisioned that other handle types may be employed in a BSAP system such as, but not limited to, extended handles, recesses, etc. At the base of the embodiment 110, metal edging or strapping 113 may be affixed to the panels 111 in order to improve structural rigidity and durability of the overall system. A pair of wheels or casters 114 may also be mounted along the edging 113 on central panel 111C. Advantageously, a user of the embodiment 110 may manage the system by leveraging handles 112 to tilt the weight of embodiment 110 onto the casters 114 and thereby rolling the entire system 110 from one place to another much like using a dolly.

Further, as can be seen in the FIG. 2 illustration, the edge panel 111E includes a sliding lock mechanism 130. The sliding lock mechanism 130 rides in a grooved frame 132 set in an opening through panel 111E and may be translated between a "closed state" and an "open state." In the particular embodiment 110, the sliding lock mechanism 130 is in the open state when it is positioned at a left-most position of grooved frame 132 and it is in the closed state when it is positioned at a right-most position of grooved frame 132. The sliding lock mechanism 130 may incorporate a lock 131, such as a keyed lock, that when in a locked state prevents a user from transitioning the sliding lock mechanism 130 from its closed state to its open state and vice versa.

As will become better understood from subsequent figures and description, the sliding lock mechanism 130 corresponds with a retracting anchor arm mechanism 140 (not shown in the FIG. 2 illustration) on the back of the embodiment 110. When the sliding lock mechanism 130 is in its open state, the retracting anchor arm mechanism 140 is in its storage state. And, when the sliding lock mechanism 130 is in its closed state, the retracting anchor arm mechanism 140 is in its deployed state. The purpose and function of the retracting arm mechanism 140 in its storage and deployed states will be shown and described in more detail that follows.

Figure 3:
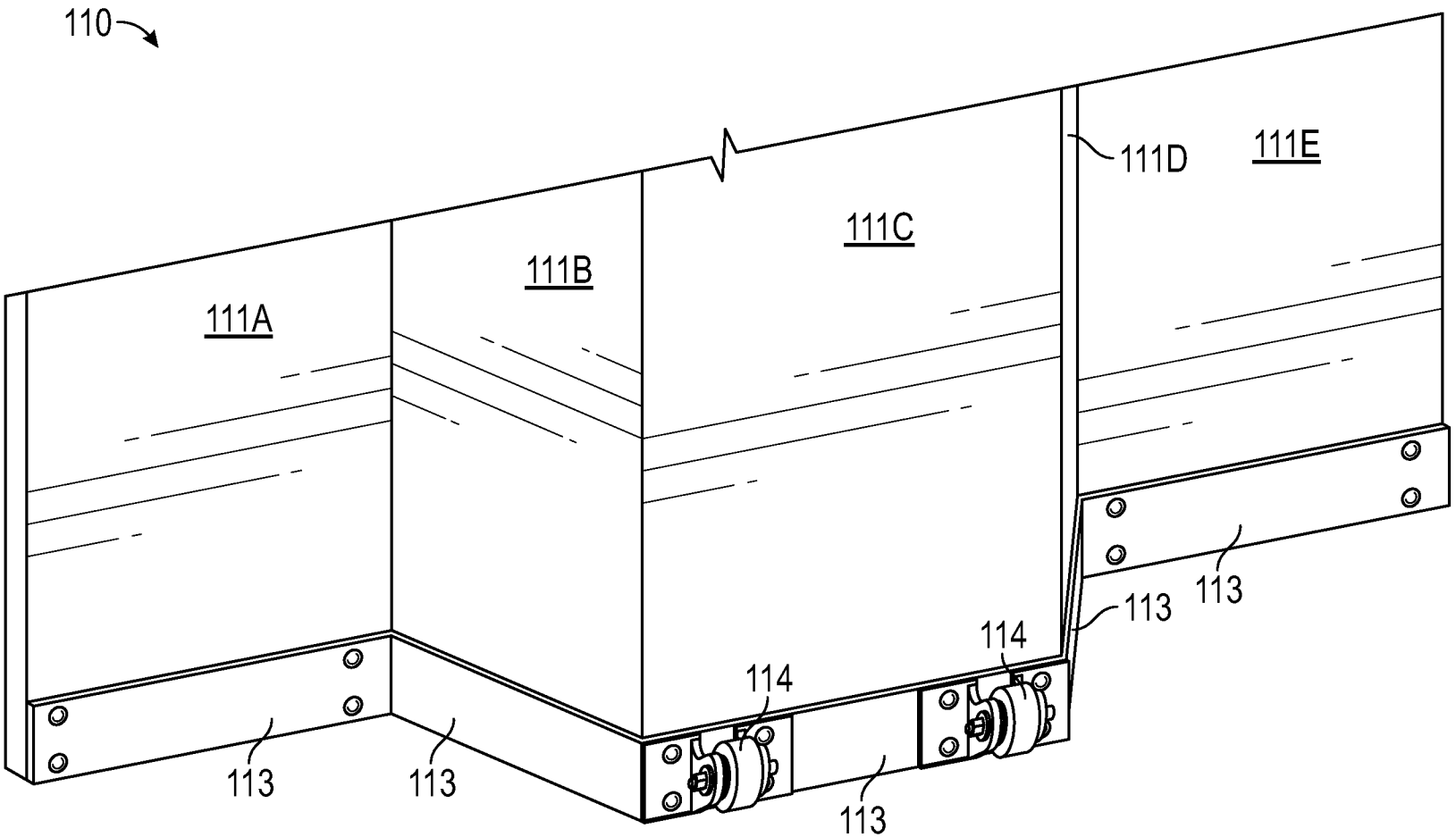
FIG. 3 is a close-up view of the front, lower portion of the BSAP embodiment illustrated in FIG. 2.

FIG. 3 is a close-up view of the front, lower portion of the BSAP embodiment 110 illustrated in FIG. 2. As previously described, metal edging or strapping 113 may be affixed to the base of panels 111 in order to improve structural rigidity and durability of the overall system. A pair of wheels or casters 114 may also be mounted along the edging 113 on central panel 111C. Advantageously, a user of the embodiment 110 may manage the system by leveraging handles 112 to tilt the weight of embodiment 110 onto the casters 114 and thereby rolling the entire system 110 from one place to another much like using a dolly.

Figure 4:
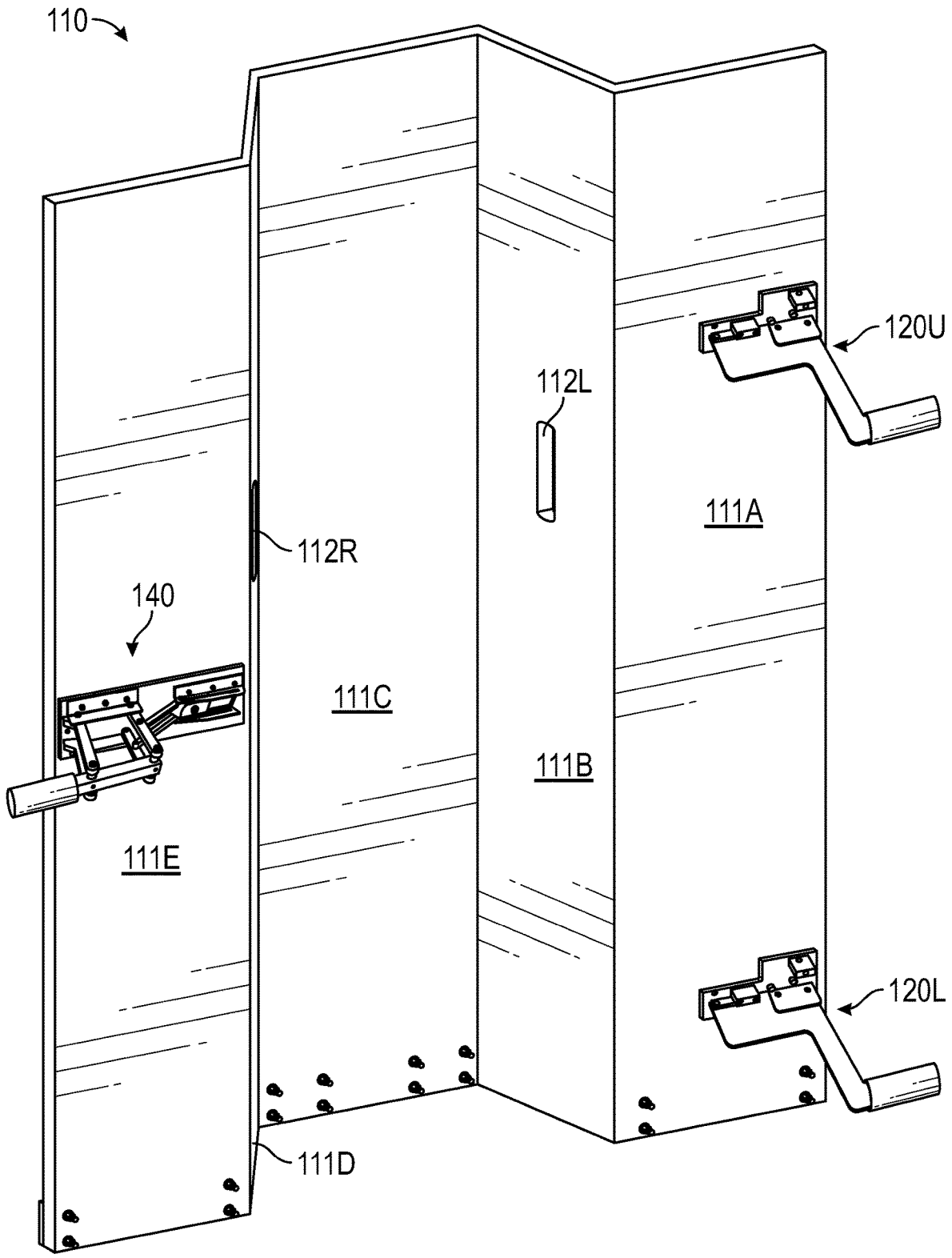
FIG. 4 illustrates the back of the exemplary BSAP embodiment illustrated in FIG. 2.

FIG. 4 illustrates the back of the exemplary BSAP embodiment 110 illustrated in FIG. 2. Viewing the back of BSAP embodiment 110 it can be better understood how middle panels 111B and 111D work with central panel 111C to define a vertical cavity. The vertical cavity may be sized to easily receive handrails associated with a stairway of a retracted bleacher system.

The back of edge panel 111A includes an upper and lower pair of anchor arm mechanisms 120U, 120L. The anchor arm mechanisms 120 may be in either of a storage state or a deployed state. In the FIG. 4 illustration, both the upper and lower anchor arm mechanism 120 is depicted in a deployed state. The anchor arm mechanisms 120 will be shown and described in more detail in subsequent figures (namely, FIGS. 5 and 6).

On the opposite side of the embodiment 110, a retracting anchor arm mechanism 140 is located on the back of edge panel 111E. As previously described, the retracting anchor arm mechanism 140 may be in mechanical communication with sliding lock mechanism 130 accessible on the front of edge panel 111E. The retracting anchor arm mechanism 140 may be in either of a storage state or a deployed state, each of those states respectively corresponding to an open state and a closed state for sliding lock mechanism 130. In the FIG. 4 illustration, the retracting anchor arm mechanism 140 is depicted in a deployed state. The retracting anchor arm mechanism 140 will be shown and described in more detail in subsequent figures (namely, FIGS. 7 and 8).

Figure 5:
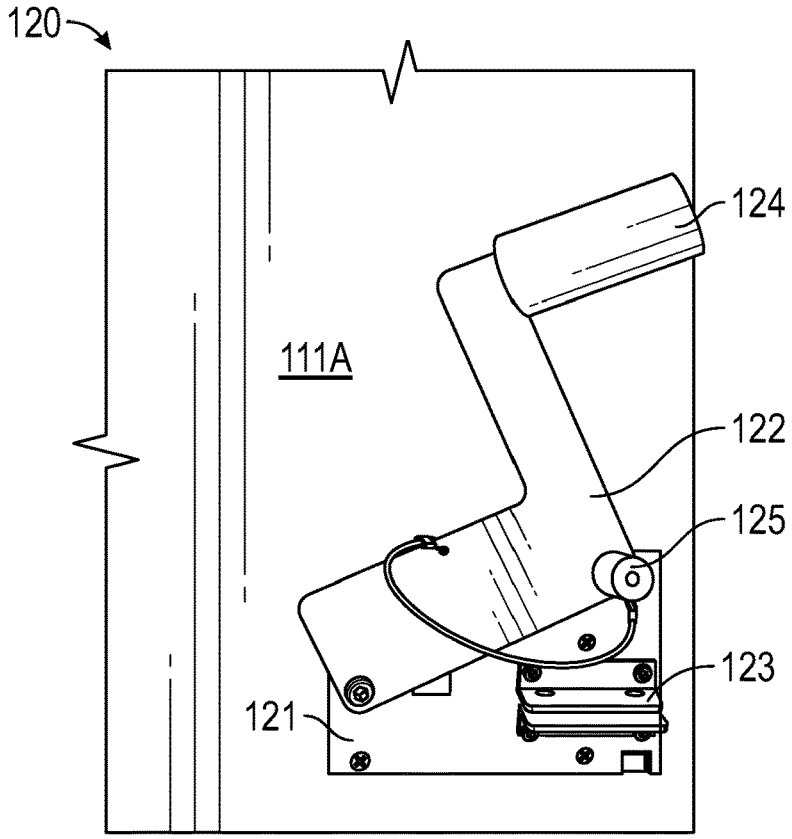
FIG. 5 is a close-up view of an anchor arm mechanism that resides on the back surface of an exemplary BSAP system according to the solution, shown in its storage state.

Turning now to the FIG. 5 illustration, depicted is a close-up view of an anchor arm mechanism 120 that resides on the back surface of an exemplary BSAP system according to the solution, shown in its storage state. Briefly referring back to the FIG. 4 illustration, upper and lower anchor arm mechanisms 120 are shown positioned along the back of edge panel 111A. Notably, although the exemplary embodiment illustrates a pair of anchor arm mechanisms 120 on the back of edge panel 111A, embodiments of the solution are not limited to the employ of any particular number of anchor arm mechanisms or, for that matter, limited to the employ of anchor arm mechanisms on a one particular side of a BSAP system.

In the FIG. 5 illustration, the anchor arm mechanism 120 is shown in a storage state. As previously described, one or more anchor arm mechanisms 120 may be positioned on the back surface of a BSAP system 110 and to one side. When not in use, the anchor arm mechanism 120 may be kept in a storage state as depicted in the FIG. 5 illustration. The exemplary anchor arm mechanism 120 may be comprised of a mounting plate 121 that includes a channel aspect 123. The exemplary channel aspect 123 shown in the FIG. 5 illustration is formed by opposing "L-shaped" brackets positioned such that a gap between them is sized for receipt of the base of an arm aspect 122.

Figure 6:
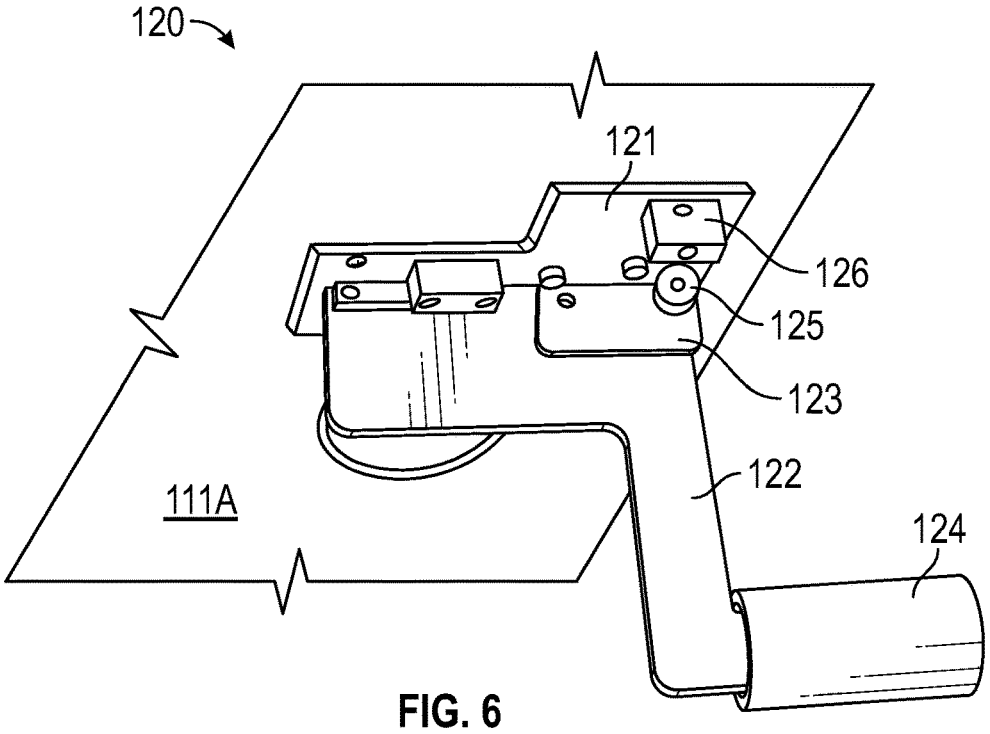
FIG. 6 is a close-up view of the anchor arm mechanism illustrated in FIG. 5, shown in its deployed state.

The arm aspect 122 may include an anchor portion 124 and a locking pin 125. In the storage state, such as is shown in the FIG. 5 illustration, the arm aspect 122 may be laid on its side such that the locking pin 125 may be inserted through the arm aspect 122 to hold it against the mounting plate 121. A mounting block aspect 126 (see FIG. 6 illustration) may be configured to receive the locking pin 125. In this way, when the BSAP system 110 is not in use, the anchor arm aspect(s) 120 may be conveniently held in an unobtrusive, low-profile position. In other embodiments, the storage state for an anchor arm aspect may include a magnet for holding the anchor arm mechanism 120 in a flat position against the mounting plate 121 (assuming that the mounting plate is constructed of a ferrous material) or, alternatively, a tether for allowing the anchor arm mechanism 120 to simply "hang" from an eyelet or other anchor point provided on the back of panel 111A.

The FIG. 6 illustration is a close-up view of the anchor arm mechanism 120 illustrated in FIG. 5, shown in its deployed state. In FIG. 6, the base of arm aspect 122 has been received into the channel aspect 123 such that the anchor portion 124 is positioned out and away from the edge of edge panel 111A of the BSAP system 110. The locking pin 125 is inserted through the channel aspect 123 to secure the arm aspect 122 in place. Notably, with the anchor arm mechanism 120 in this deployed state, the BSAP system 110 may be rotated such that the anchor arm portion 124 is inserted into a space behind a given bleacher bench 105 and the system 110 is positioned substantially flush with the vertical wall defined by the front of the bleacher benches 105. More detail regarding how certain embodiments of a BSAP solution may be installed over a retracted bleacher set will be shown and described in subsequent figures. Again, it is envisioned that a BSAP system according to the solution may include any number of anchor arm mechanisms 120 along at least one edge of the back surface of a panel 111 such that the anchor arm portion 124 of each may be received into and/or behind a bleacher bench.

Figure 7:
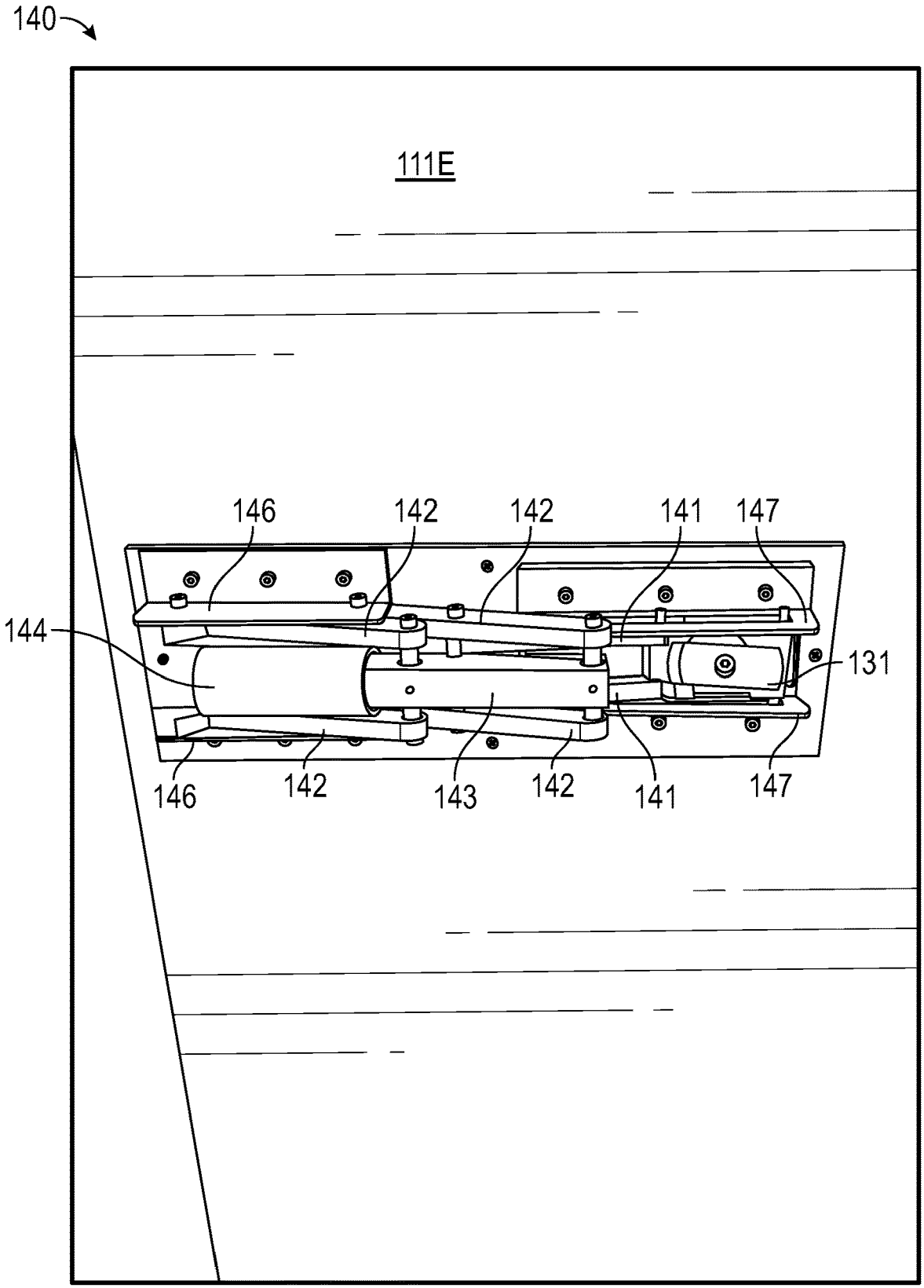
FIG. 7 illustrates a retracting anchor arm mechanism that resides on the back surface of an exemplary BSAP system according to the solution, such as the BSAP embodiment illustrated supra, and is in mechanical communication with a sliding lock mechanism that resides on the front surface of the exemplary BSAP system, shown in a storage state associated with the open state of the sliding lock mechanism.
Figure 8:
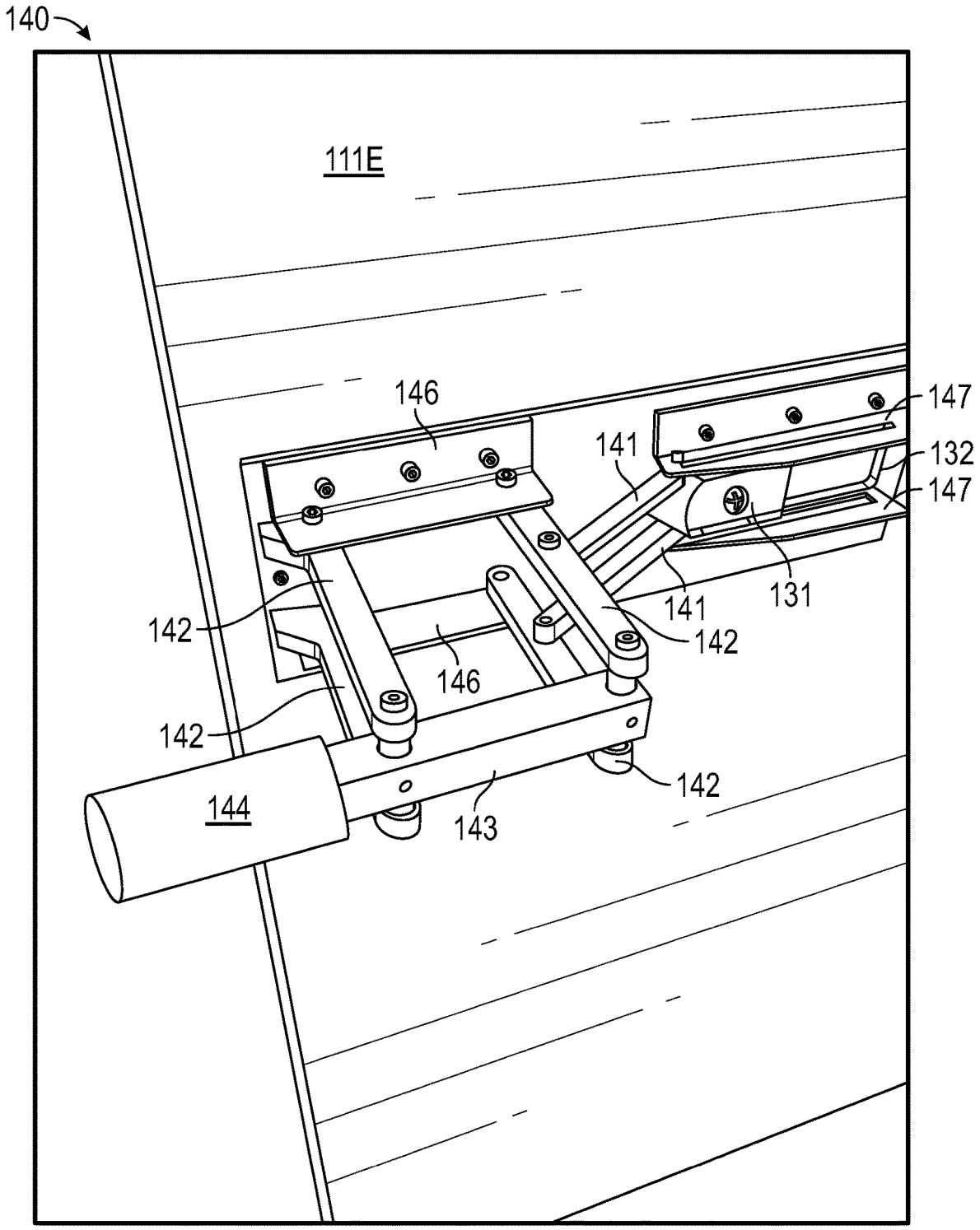
FIG. 8 illustrates the retracting anchor arm mechanism of FIG. 7, shown in a deployed state associated with the closed state of the sliding lock mechanism.

FIG. 7 illustrates a retracting anchor arm mechanism 140 that resides on the back surface of an exemplary BSAP system according to the solution, such as the BSAP embodiment 110 illustrated supra, and is in mechanical communication with a sliding lock mechanism 130 that resides on the front surface of the exemplary BSAP system, shown in a storage state associated with the open state of the sliding lock mechanism 130. FIG. 8 illustrates the retracting anchor arm mechanism 140 of FIG. 7, shown in a deployed state associated with the closed state of the sliding lock mechanism 130. The FIG. 7 and FIG. 8 illustrations will be described together.

As can be understood from the FIGS. 7 and 8 illustrations, the exemplary retracting anchor arm mechanism 140 includes a pair of parallel four-bar linkage mechanisms, as would be understood by one of ordinary skill in the art of engineering science and mechanics. Four bars or rods 142 are each pivotally attached at one end to one of two anchor plates 146. In four bar mechanism terminology, the anchor plates 146 are ground links and the rods 142 are rocker links. More specifically, two of the four bars 142 are pivotally attached at one end to one of two anchor plates 146 and the other two of the four bars 142 are pivotally attached at one end to a second of the two anchor plates 146. Each pair of bars 142 are connected together via retracting anchor arm 143 (the coupler link). In this way, as the rods 142 are rotated toward the edge of the panel 111E, the retracting anchor arm 143 lifts away from panel 111E and extends outward from the edge of panel 111E. Conversely, as the rods 142 are rotated away from the edge of panel 111E, the retracting anchor arm 143 is brought down toward panel 111E and nested in a storage state (such as depicted in the FIG. 7 illustration).

The rods 142 and retracting anchor arm 143 (with engagement end 144) are extended toward the edge of panel 111E via extension arms 141 when sliding lock mechanism 130 is translated to its closed position (as depicted in FIG. 8). The rods 142 and retracting anchor arm 143 are brought back to nest against panel 111E (thereby pulling engagement end 144 back from its extended position) via extension arms 141 when sliding lock mechanism 130 is translated to its open position (as depicted in FIG. 7). The engagement end 144 of retracting anchor arm 143 may comprise a rubberized surface treatment or some other cushioning aspect useful for mitigating damage to bleacher seats that may be cause by friction.

Actuation of the lock 131 on sliding lock mechanism 130 will cause the lock 131, which includes an oblong plate, to rotate and engage, or disengage, with a pair of grooves 147 in the back of frame 132. This can best be understood from the FIG. 8 illustration. Simply put, translation of the sliding lock mechanism 130 on the front of panel 111E to its open position will correspond to having the engagement end 144 of the retracting anchor arm mechanism 140 retracted from its extended position behind the bleachers and return it to a storage state (FIG. 7). Similarly, translation of the sliding lock mechanism 130 on the front of panel 111E to its closed position will correspond to having the engagement end 144 of the retracting anchor arm mechanism 140 extended from its retracted position into a deployed state in order to engage the bleachers and lock the system over the stairway (FIG. 8.)

Figure 9:
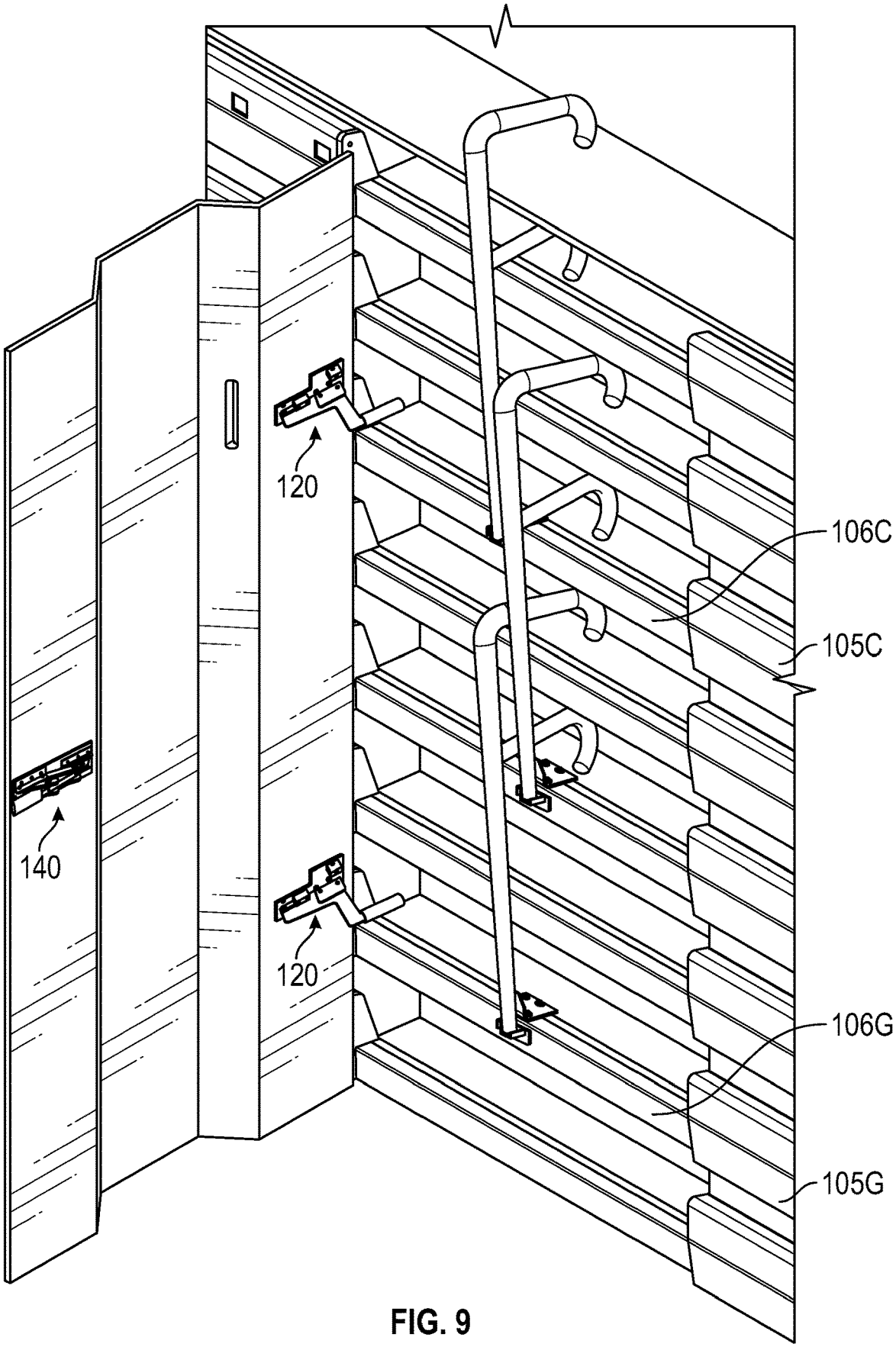
FIG. 9 illustrates the exemplary BSAP system embodiment of FIG. 2 with its anchor arms in deployed states and its retracting anchor arm in a storage state, the embodiment positioned for installation over a retracted bleacher system staircase.

FIG. 9 illustrates the exemplary BSAP system embodiment 110 of FIG. 2 with its anchor arm mechanisms 120 in deployed states and its retracting anchor mechanism 140 in a storage state, the embodiment positioned for installation over a retracted bleacher system staircase. As can be understood from the FIG. 9 illustration, the embodiment 110 is positioned perpendicularly away from the bleachers such that anchor arm mechanisms 120, in their deployed states, are positioned to be rotated back in behind respective bleacher seats 105C and 105G. A user seeking to install the system 110 over stairway 106 and rails 107 may begin by putting anchor arm mechanisms 120 in deployed states while keeping retracting anchor mechanism 140 in its storage state (corresponding to the open state for sliding lock mechanism 130) then positioning the system 110 substantially as illustrated in FIG. 9.

Figure 10:
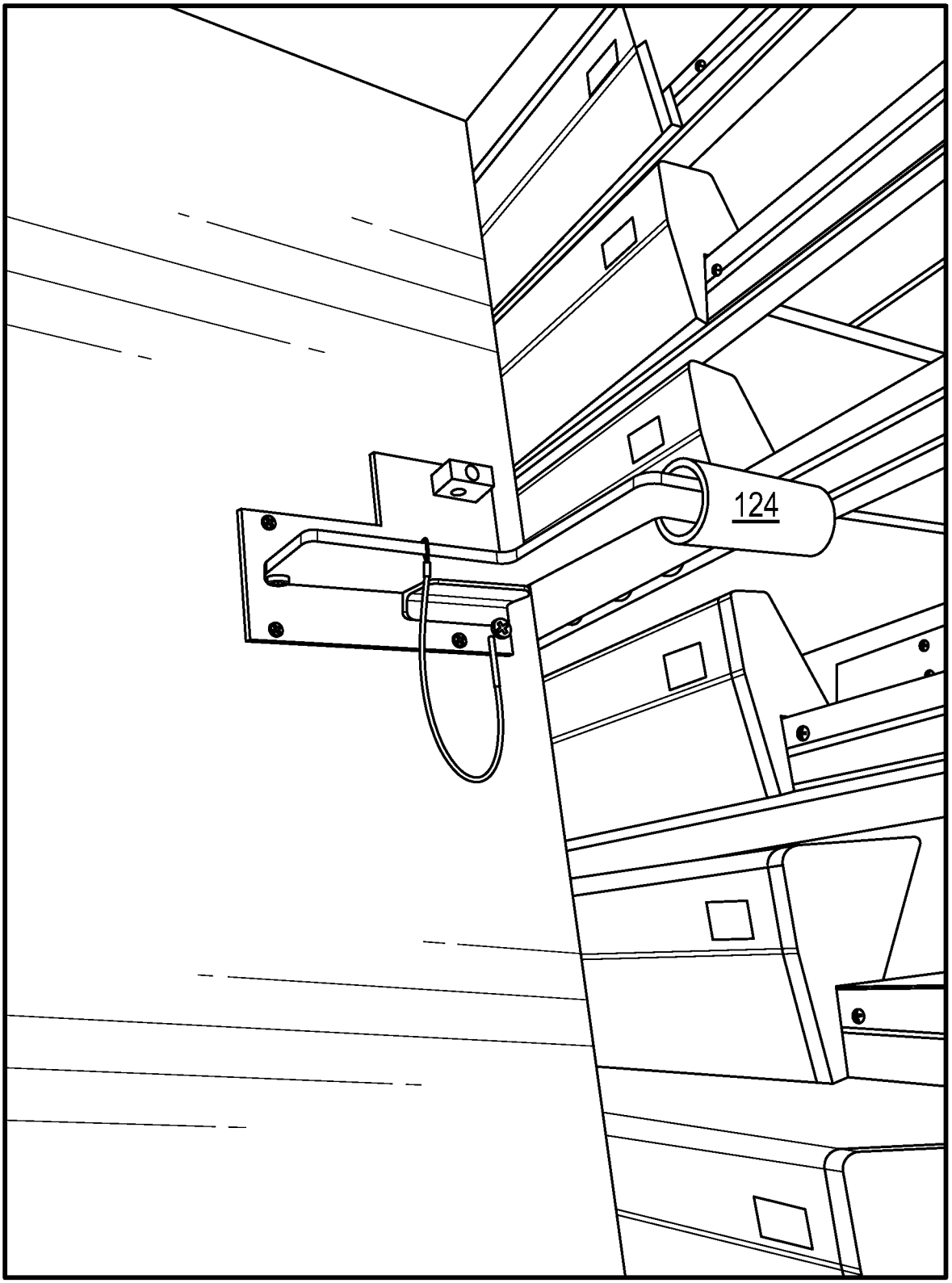
FIG. 10 is a closeup view of the deployed anchor arms illustrated in FIG. 9.

FIG. 10 is a closeup view of the deployed anchor arms illustrated in FIG. 9, showing the engagement end 124 positioned and ready to be rotated back in behind a bleacher seat.

Figure 11:
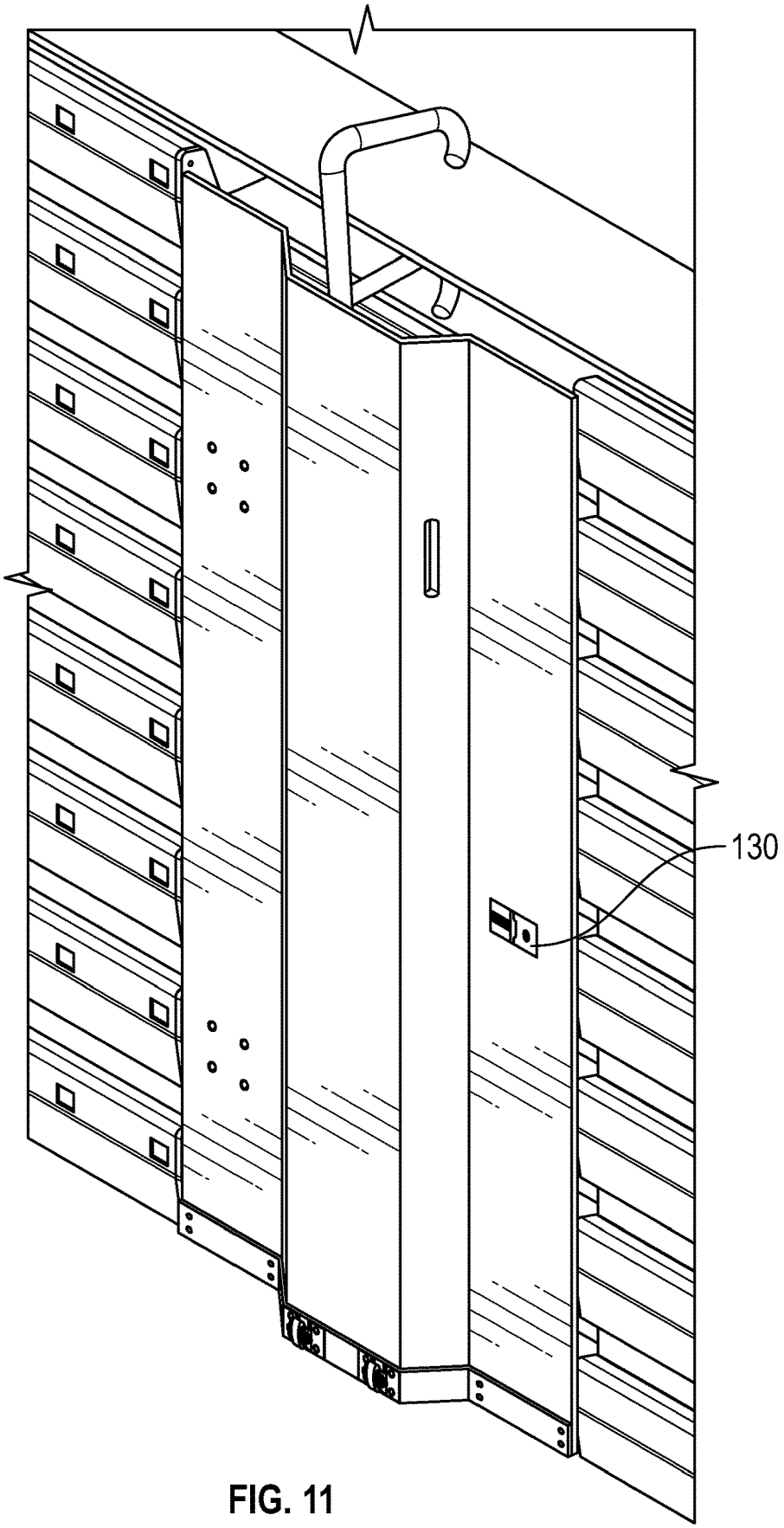
FIG. 11 illustrates the embodiment of FIG. 9 fully positioned over the retracted bleacher system staircase with the sliding lock in a closed state such that the retracting anchor arm (not shown) is in a deployed state.
Figure 12:
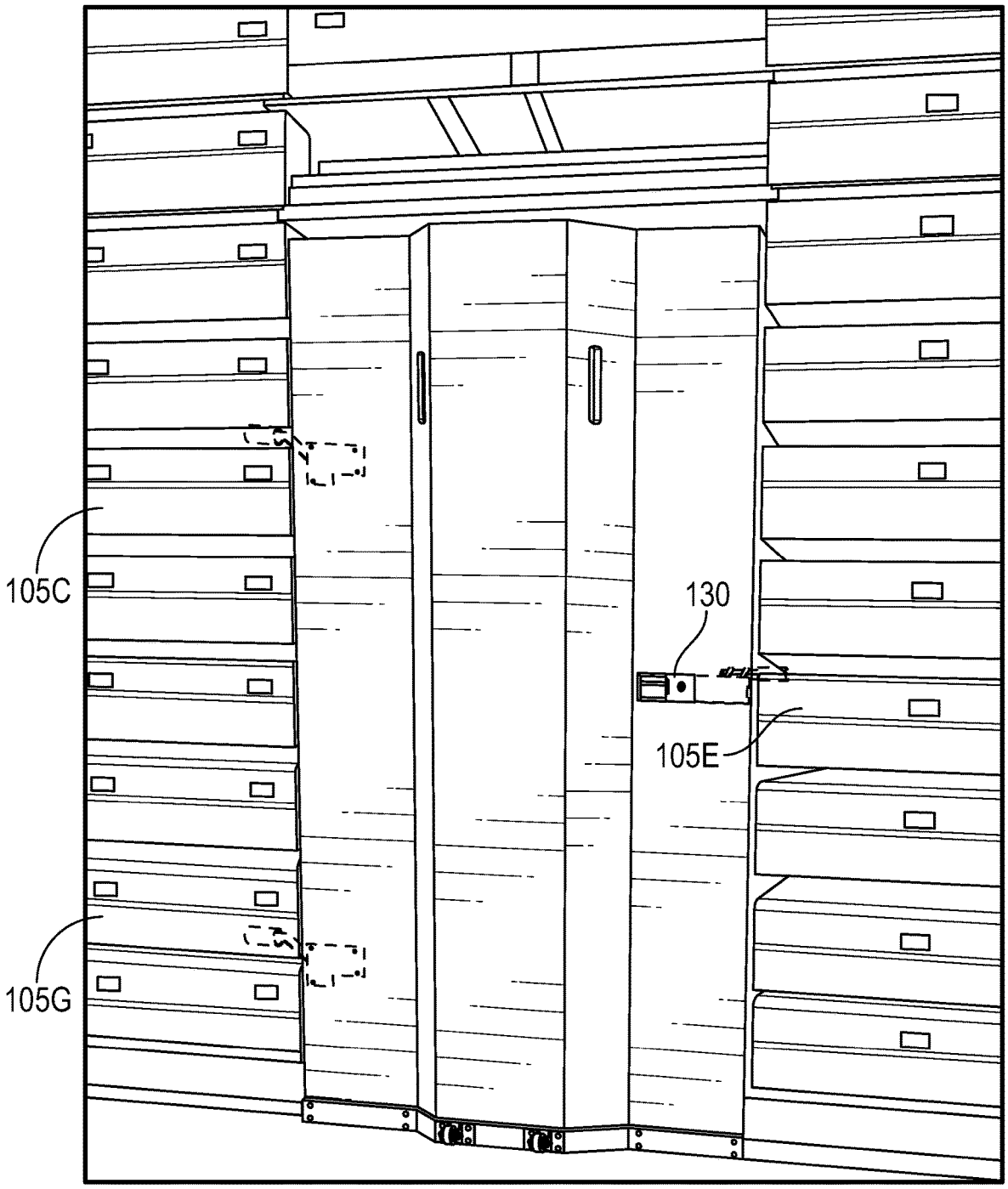
FIG. 12 is a hidden line depiction of the FIG. 11 illustration, showing the positioning of the anchor arms and retractable anchor arm behind certain bleacher seats in order to lock the embodiment in position over the staircase.

FIG. 11 illustrates the embodiment 110 of FIG. 9 fully positioned over the retracted bleacher system staircase with the sliding lock mechanism 130 in a closed state such that the retracting anchor arm (not shown) is in a deployed state. FIG. 12 is a hidden line depiction of the FIG. 11 illustration, showing the positioning of the anchor arms 120 and retractable anchor arm 140 behind certain bleacher seats in order to lock the embodiment 110 in position over the staircase. As can be understood from the FIG. 11 and FIG. 12 illustrations, the system 110 has been rotated such that edge panels 111 are substantially in plane with the outer surfaces of the bleacher seats. The engagement ends 124 of the anchor arms have thus been rotated into and behind certain bleacher seats. Once in place, as shown in the FIG. 11 and FIG. 12 illustrations, the sliding lock mechanism 130 may be translated to its closed position, thereby extending the four bar mechanisms of retracting anchor arm mechanism 140 such that the engagement end 144 of the retracting anchor arm 143 is extended into an area behind a certain bleacher seat similar to the engagement ends 124 of anchor arms 120 on the opposite side of the system 110. In this way and advantageously, the embodiment 110 may be locked in position over the stairway and rails in order to prevent access to the stairway and rails.

Figure 13:
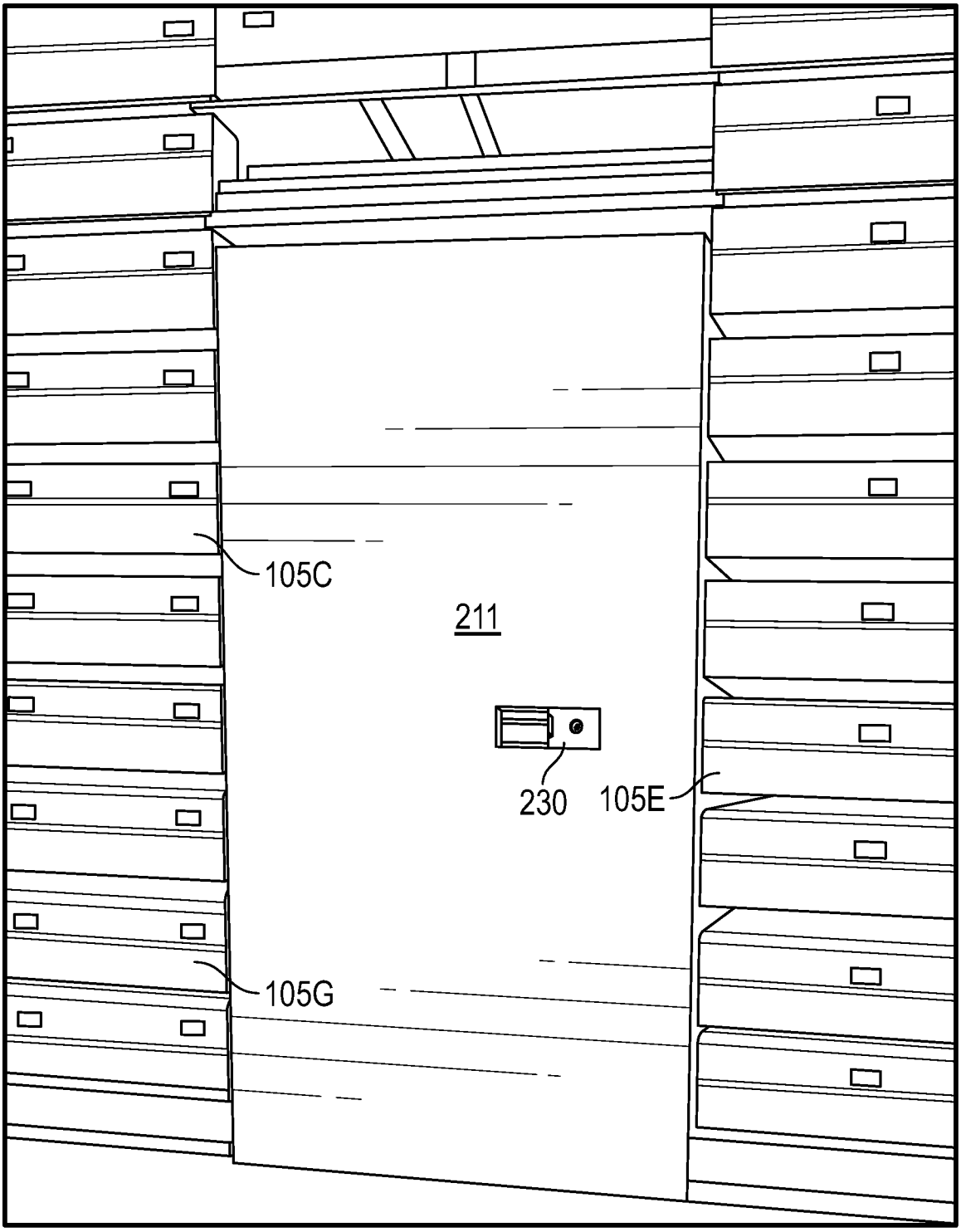
FIG. 13 is an alternative embodiment of a BSAP system according to the solution, shown positioned over a rail-less staircase of a retracted bleacher system.

FIG. 13 is an alternative embodiment of a BSAP system according to the solution, shown positioned over a rail-less staircase of a retracted bleacher system. And, FIG. 14 is a hidden line depiction of the FIG. 13 illustration, showing the positioning of the engagement ends 124 of the anchor arms 220 and the engagement end 244 of the retractable anchor arm mechanism 240 behind certain bleacher seats in order to lock the embodiment in position over the staircase.

Figure 14:
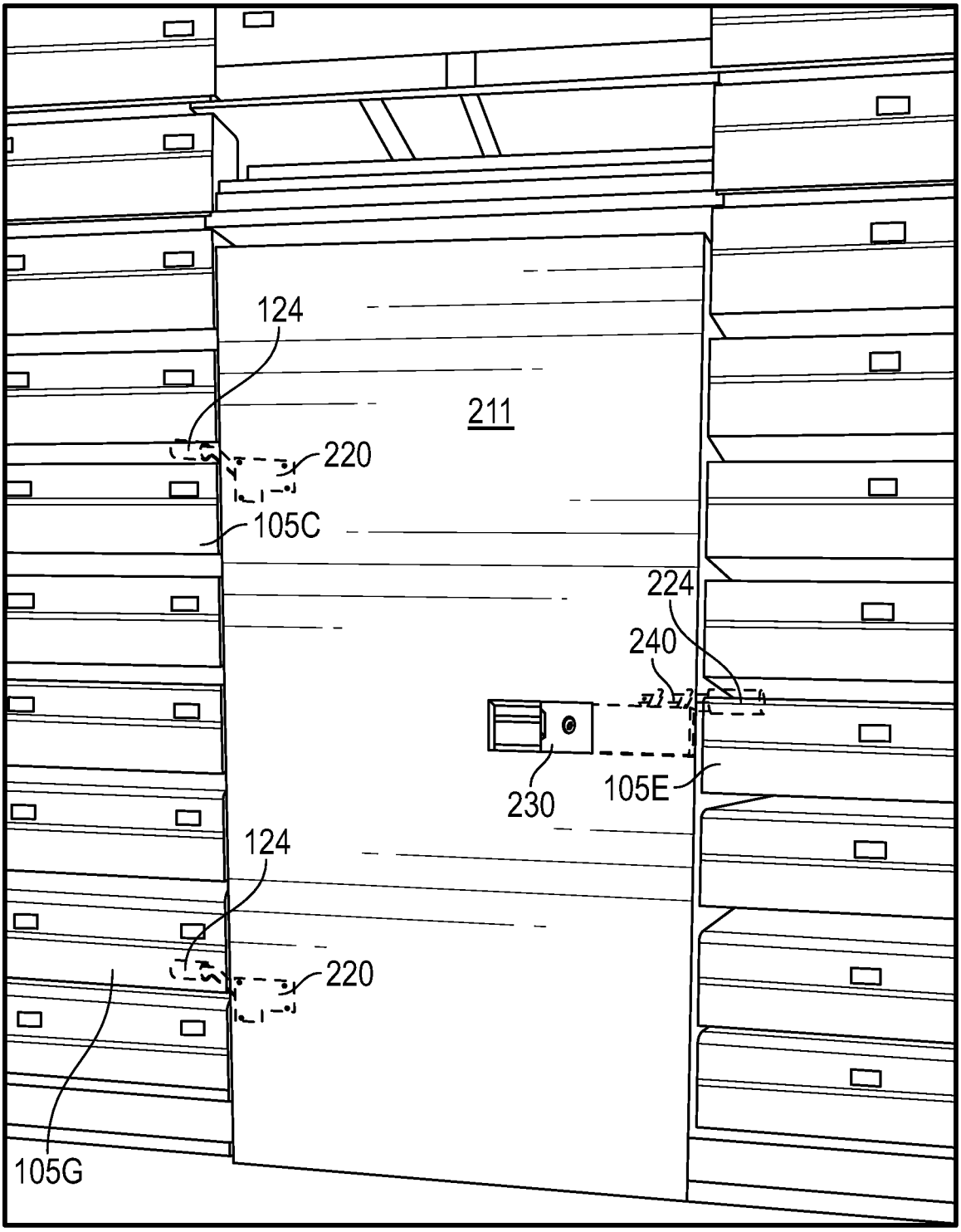
FIG. 14 is a hidden line depiction of the FIG. 13 illustration, showing the positioning of the anchor arms and retractable anchor arm behind certain bleacher seats in order to lock the embodiment in position over the staircase.

The function and application of the exemplary BSAP embodiment shown in the FIG. 13 and FIG. 14 illustrations is essentially the same as that which has been previously described, with the exception of the panel 211 being a single flat panel as opposed to a series of connected panels 111. The sliding lock mechanism 230 that resides on the front surface of a main panel 211, shown in a closed state in FIGS. 13 and 14. As previously described, the sliding lock mechanism 230 may include a lock for locking in place the position of the sliding lock mechanism 230 and, by extension, the state of the retracting arm mechanism 240. When the sliding lock mechanism 230 is in the open state, the retracting anchor arm mechanism 240 is in the retracted state such that the anchor portion 244 is nested against main panel 211.

With the sliding lock mechanism 230 in its closed state, the retracting anchor arm mechanism 240 is transitioned to an extended state such that the anchor portion 244 is positioned out and away from the main panel 211. As can be understood from the illustrations, the anchor portion 244 may be actuated via a four-bar mechanism arrangement. The lock on the sliding lock mechanism 230 may be actuated to rotate a locking plate into a groove or other receiving feature on the back of panel 211 such that the state of the retracting anchor arm mechanism 240, whether retracted or extended, may be secured.

With the anchor arm aspects 220 in their deployed states (as depicted in FIG. 14) and the retracting anchor arm aspect 240 in its retracted state, the BSAP system may be rotated into position over a stairway of a retracted bleacher system. The anchor arm portions 124, being in their deployed positions, may be received into spaces behind given bleacher benches 105 such that the main panel 211 is substantially flush with a plane defined by front surfaces of the various bleacher benches 105. Next, the sliding lock mechanism 230 may be translated from its open state to its closed state, thereby operating to transition the associated retracting anchor arm mechanism 240 from its retracted state to its extended state such that the anchor portion 244 is received into a space behind a given bleacher bench. The retracting anchor arm mechanism 240 may be locked in its extended position by actuation of a lock integrated into the sliding lock mechanism. Advantageously, with anchor arm portions 124 and 144 secured in spaces behind bleacher benches, the BSAP system may prevent access to the stairways.

Systems and methods according to the solution for a bleacher step access prevention "BSAP" system that prevents access to stairways of retracted bleacher systems have been described using detailed descriptions of embodiments thereof. The exemplary embodiments have been provided by way of example and are not intended to limit the scope of the disclosure. The described embodiments comprise different features, not all of which are required in all embodiments of the solution. Some embodiments of the solution utilize only some of the features or possible combinations of the features. Variations of embodiments of the solution that are described and embodiments of the solution comprising different combinations of features noted in the described embodiments will occur to persons of the art. For example, although the exemplary embodiments illustrated and described in this disclosure feature anchor arm components on one edge of a panel component and a retracting anchor arm component on an opposite edge of the panel component, such is not limiting of the scope of the disclosure—it is envisioned that certain embodiments may feature one or more retracting anchor arm components positioned in association with a panel edge that is also associated with one or more anchor arm components.

It will be appreciated by persons skilled in the art that a system or method according to the solution for bleacher step access prevention is not limited by what has been particularly shown and described herein above. Rather, the scope of the disclosed solution is defined by the claims that follow.

What is claimed is:

1. A bleacher step access prevention system for preventing access to a stairway of a bleacher system when the bleacher system is in a retracted state, the bleacher system comprising a plurality of bleacher benches and at least one stairway interior to the bleacher system such that the plurality of bleacher benches extend laterally to either side of the at least one stairway and define a vertical wall when the bleacher system is in the retracted state, the bleacher step access prevention system comprising:

a panel component;

at least one anchor component associated with the panel component;

at least one actuatable anchor component associated with the panel component; and a lock mechanism associated with the panel component and operable when actuated to transition the actuatable anchor component between a storage state and a deployed state;

wherein, when the panel component is placed in front of an interior stairway of a retracted bleacher system, the at least one anchor component is engaged in a first space behind a bleacher bench and actuation of the lock mechanism causes the at least one actuatable anchor component to transition to a deployed state and engage in a second space behind a bleacher bench.

2. The bleacher step access prevention system of claim 1, wherein the panel component is comprised of a plurality of panel surfaces configured to define a cavity for accommodating handrails associated with the stairway of the retracted bleacher system.

3. The bleacher step access prevention system of claim 2, wherein at least two of the plurality of panel surfaces are connected via hinges.

4. The bleacher step access prevention system of claim 2, wherein the panel component is comprised of a thermoplastic and the plurality of panel surfaces are defined by creases in the thermoplastic.

5. The bleacher step access prevention system of claim 2, wherein the plurality of panel surfaces are integrally connected via welds.

6. The bleacher step access prevention system of claim 1, wherein the panel component further comprises one or more handles.

7. The bleacher step access prevention system of claim 1, further comprising at least one caster mounted along a base edge of the panel component.

8. The bleacher step access prevention system of claim 1, further comprising a reinforcement edging component along a base edge of the panel component.

9. The bleacher step access prevention system of claim 8, wherein the panel component is comprised of a thermoplastic and the reinforcement edging component is comprised of a metal.

10. The bleacher step access prevention system of claim 1, wherein the at least one anchor component is configured to transition between a storage state and a deployed state.

11. The bleacher step access prevention system of claim 10, wherein the at least one anchor component further comprises a locking pin operable to mechanically hold the anchor component in either of the storage state or the deployed state.

12. The bleacher step access prevention system of claim 1, wherein the at least one actuatable anchor component comprises a four bar linkage arrangement.

13. The bleacher step access prevention system of claim 1, wherein the lock mechanism further comprises an access lock operable to prevent the lock mechanism from being actuated.

14. The bleacher step access prevention system of claim 13, wherein the access lock is a keyed lock.

15. The bleacher step access prevention system of claim 1, wherein when the panel component is placed in front of a stairway of a retracted bleacher system at least a portion of the panel component defines a plane that is substantially parallel with a plane defined by fronts of bleacher benches in the retracted bleacher system.

16. The bleacher step access prevention system of claim 1, wherein the panel component is configured to receive and display artwork or advertising.

* * * * *